US008255163B2

(12) United States Patent
Mauldin et al.

(10) Patent No.: US 8,255,163 B2
(45) Date of Patent: Aug. 28, 2012

(54) DOWNHOLE DRILLING VIBRATION ANALYSIS

(75) Inventors: Charles Lee Mauldin, Spring, TX (US); Barry Vincent Schneider, Spring, TX (US); Mark Adrian Smith, Houston, TX (US)

(73) Assignee: Precision Energy Services, Inc., Fort Worth, TX (US)

( * ) Notice: Subject to any disclaimer, the term of this patent is extended or adjusted under 35 U.S.C. 154(b) by 415 days.

(21) Appl. No.: 12/570,015

(22) Filed: Sep. 30, 2009

(65) Prior Publication Data

US 2010/0082256 A1 Apr. 1, 2010

Related U.S. Application Data

(60) Provisional application No. 61/101,540, filed on Sep. 30, 2008.

(51) Int. Cl.
*G06F 19/00* (2006.01)
*G01V 1/40* (2006.01)

(52) U.S. Cl. ..... 702/9; 702/6

(58) Field of Classification Search ..... 702/1–16, 702/55, 141, 183; 175/45–50, 40; 336/132; 367/57, 85

See application file for complete search history.

(56) References Cited

U.S. PATENT DOCUMENTS

| | | | | |
|---|---|---|---|---|
| 6,151,554 | A | 11/2000 | Rodney | |
| 6,722,450 | B2 | 4/2004 | Schultz et al. | |
| 7,286,959 | B2 | 10/2007 | Steinke | |
| 7,313,480 | B2 * | 12/2007 | Chen et al. | 702/9 |

FOREIGN PATENT DOCUMENTS

WO 2004065749 8/2004

OTHER PUBLICATIONS

Examiner's first report on Australian patent application No. 2009222482, dated Feb. 3, 2011.
Drilling Contractor, "Weatherford sensors track vibration to increase ROP, temperature change for early kick detection," Mar./Apr. 2008, pp. 46-47.
Weatherford International, Inc., "HEL(TM) MWD System—Environmental Severity Measurement (ESM(TM)) Sensor," Brochure 2772.03, copyright 2006.
Drilling Contractor, "Innovating While Drilling," Mar./Apr. 2008, pp. 36-37.
First Office Action in counterpart Canadian Appl. No. 2,680,942, dated Aug. 26, 2011.
Notice of Acceptance in counterpart Australian Appl. No. 2009222482, dated Mar. 14, 2012.

* cited by examiner

*Primary Examiner* — John H Le
(74) *Attorney, Agent, or Firm* — Wong, Cabello, Lutsch, Rutherford & Brucculeri, LLP

(57) ABSTRACT

Downhole drilling vibration analysis uses acceleration data measured in three orthogonal axes downhole while drilling to determine whether drilling assembly's efficiency has fallen to a point where the assembly needs to be pulled. In real or near real time, a downhole tool calculates impulse in at least one direction using the measured acceleration data over an acquisition period and determines whether the calculated impulse exceeds a predetermined acceleration threshold for the acquisition period. If the impulse exceeds the threshold, the tool pulses the impulse data to the surface where the calculated impulse is correlated to efficiency of the assembly as the drillstring is used to drill in real time. Based on the correlation, operators can determine whether to pull the assembly if excessive impulse occurs continuously over a predetermined penetration depth.

35 Claims, 11 Drawing Sheets

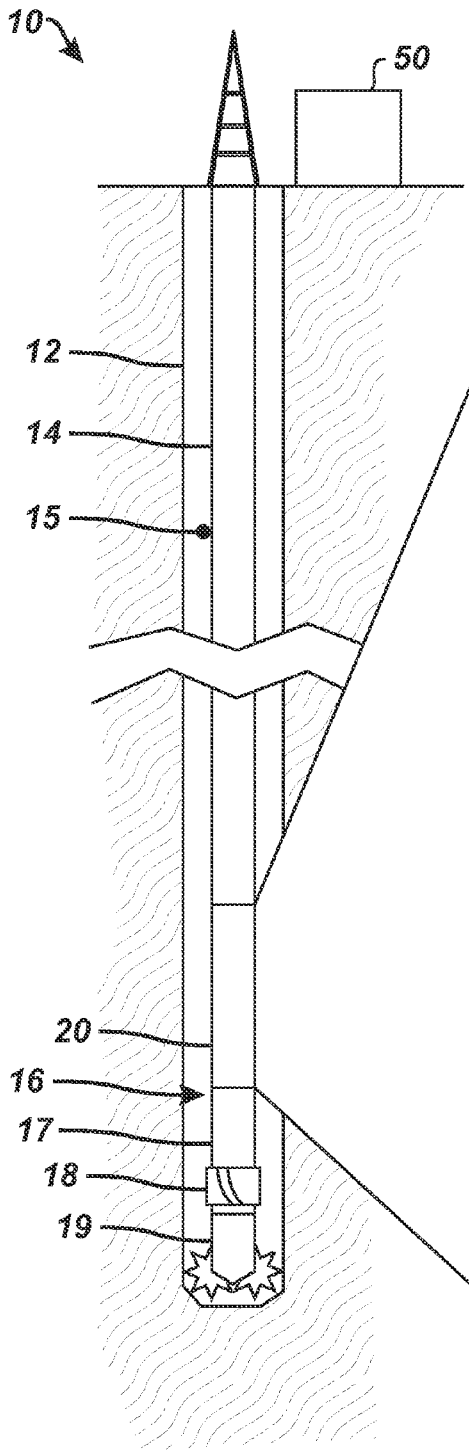
FIG. 1
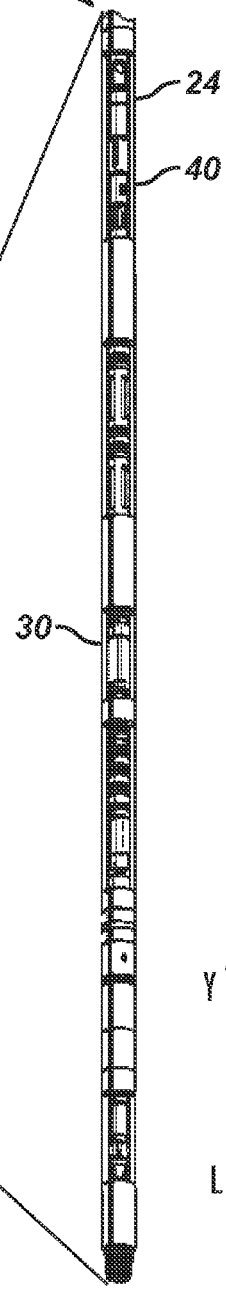
FIG. 2A
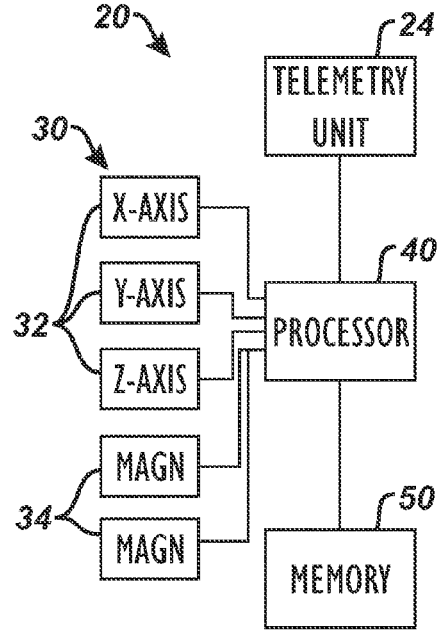
FIG. 2B
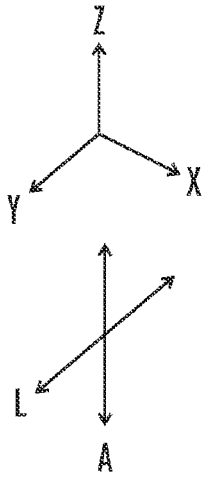

DOWNHOLE DRILLING VIBRATION ANALYSIS

CROSS-REFERENCE TO RELATED APPLICATIONS

This is a non-provisional of U.S. Provisional Application Ser. No. 61/101,540, filed 30 Sep. 2008, which is incorporated herein by reference and to which priority is claimed.

BACKGROUND

During drilling, energy at the rig floor is applied to the drill assembly downhole. Vibrations occurring in the drill string can reduce the assembly's rate of penetration (ROP). Therefore, it is useful to monitor vibration of the drill string, bit, and bottom hole assembly (BHA) and to monitor the drilling assembly's revolutions-per-minute (RPM) to determine what is occurring downhole during drilling. Based on the monitored information, a driller can change operating parameters to improve the weight on the bit (WOB), drilling collar RPM, and the like to increase efficiency.

During drilling, lateral and axial impact to the drilling assembly wears the assembly's components (e.g., stabilizer, drill bit, or the like) down and decreases the assembly's rate of penetration (ROP)—i.e., its effectiveness in drilling through a formation. When the assembly loses its effectiveness, the assembly or a portion of it may need to be replaced or repaired. This often requires that the entire drill string be tripped out from the borehole so that a new component can be installed. As expected, this is a time-consuming and expensive process. Therefore, real-time knowledge of the effectiveness of a drilling assembly can be particularly useful to drill operators.

SUMMARY

In downhole drilling vibration analysis, a downhole tool measures acceleration data in three orthogonal axes while drilling with a drilling assembly. Using the measure data, the impulse in at least one direction is calculated over an acquisition period. For example, the impulse can be calculated in an axial direction derived from acceleration data in the z-axis and can be calculated in a lateral direction derived from acceleration data in the x-axis and y-axis. Likewise, the impulse can be calculated in combination of the axial and lateral directions derived from acceleration data in all three orthogonal axis. The calculated impulse is compared to a predetermined threshold for the acquisition period to determine if the impulse exceeds the threshold. If the impulse does exceed the threshold based on the determination, the calculated impulse is correlated to the efficiency of the drilling assembly to ultimately determine whether to pull the drill assembly so components can be replaced or repaired.

A downhole drilling vibration analysis system can use a downhole tool having a plurality of accelerometers measuring acceleration data in three orthogonal axes downhole while drilling with a drilling assembly. Processing circuitry on the tool itself or at the surface can calculate the impulses in the one or more directions using the measured acceleration data over an acquisition period and can perform the analysis to determine whether to pull the drilling assembly. If at least some of the processing is performed at the surface, then the downhole tool can have a telemetry system for transmitting raw data or partially calculated results to the surface for further analysis.

The drilling assembly can have a drill bit, a drilling collar, one or more stabilizers, a rotary steerable system, and other components. The drill bit can experience wear and damage from impacts during drilling and can lose its effectiveness for drilling. Like the drill bit, other components of the drilling assembly, such as a stabilizer, can also experience similar wear and damage from impacts. Therefore, the calculated impulse can be correlated to efficiency of the entire drilling assembly, the stabilizer, the drill bit, or other components of the assembly.

The wear of the drill bit may be more likely when drilling through a hard rock formation. By contrast, the wear of the stabilizer may be more likely in softer formations. For a drilling assembly having a rotary steerable system, damage may occur to its components that prevent its proper functioning. In general, the wear of the drill bit and the stabilizers caused by impacts can have a dull characteristic that develops, making the component have an almost milled appearance.

In one implementation, for example, the predetermined threshold is 7 g, and the acquisition period is one second. To correlate the calculated impulse to the efficiency of the drilling assembly, analysis can determine whether the calculated impulse occurs continuously over a predefined penetration depth through the formation. In one example, the predefined penetration depth can be 25-feet through the formation. Depending on the particulars of the implementation, however, the values for thresholds, distances, and the like used in the calculations may be different.

If the calculated impulse does occur continuously over the predefined penetration depth of 25-ft, the drilling assembly may be pulled from the borehole because it is operating inefficiently and likely worn. Otherwise, operators may continue drilling with the assembly without prematurely pulling out the drillstring when components of the assembly, such as the drill bit or stabilizer, are not actually worn.

To actually calculate the impulse in one or more of the direction, processing integrates the rectified acceleration data in the direction over the acquisition period and counts a number of impulse shocks that exceed the predetermined threshold for the acquisition period. Then, processing correlates the value of the calculated impulse for the acquisition period to the number of impulse shocks counted for the acquisition period to calculate an impulse shock density, which is used to determine whether the bit is operation inefficiently over a drilling length. This impulse shock density can be calculated as the product of (Impulse^2/shock number) *1000.

BRIEF DESCRIPTION OF THE DRAWINGS

FIG. 1 schematically illustrates a measurement-while-drilling (MWD) system having a vibration monitoring tool according to the present disclosure.

FIG. 2A shows an isolated view of the vibration monitoring tool.

FIG. 2B diagrammatically shows components of the vibration monitoring tool.

DETAILED DESCRIPTION

Figure 3:
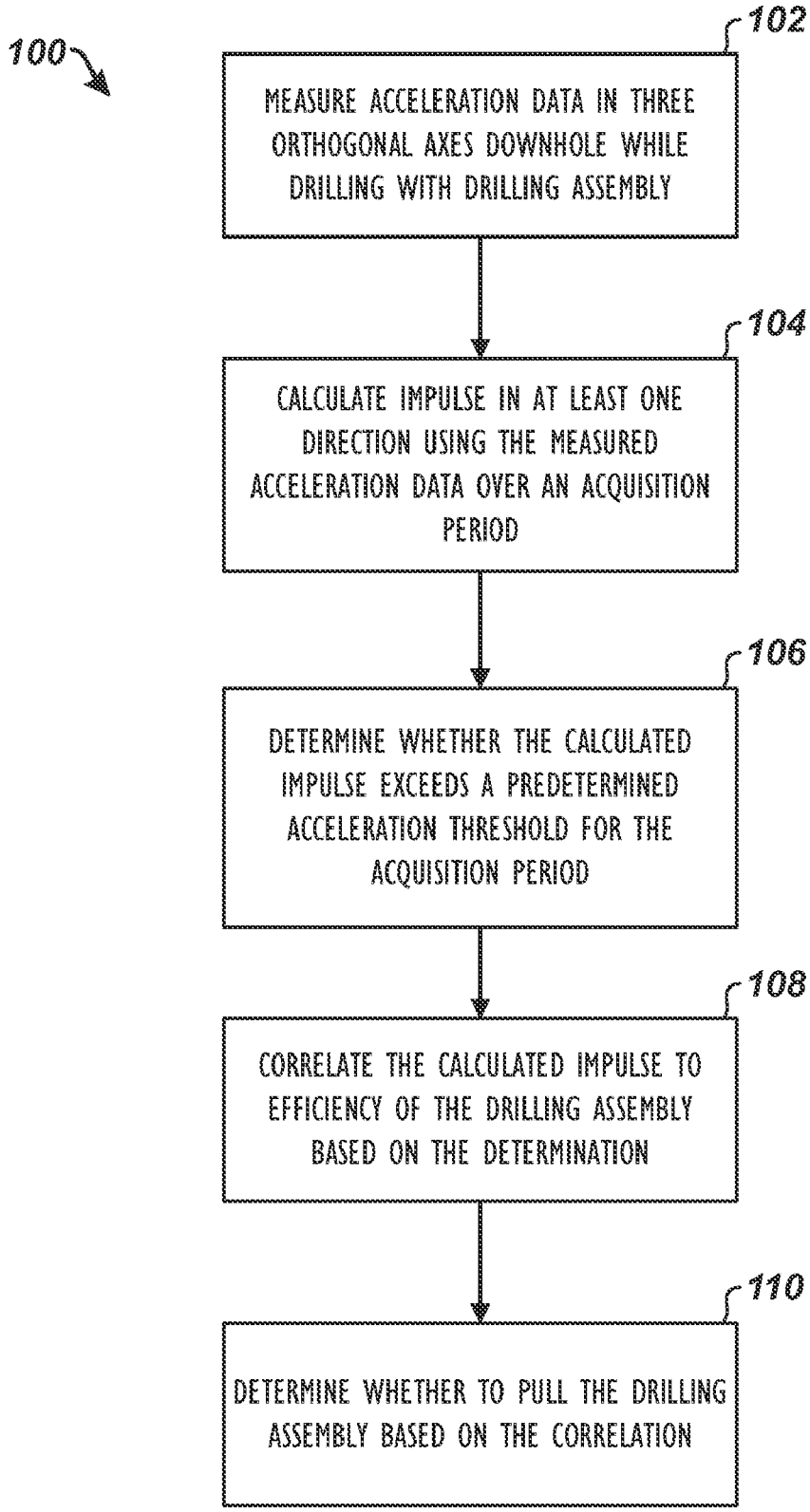
FIG. 3 is a flow chart illustrating an impulse analysis technique of the present disclosure.
Figure 4A:
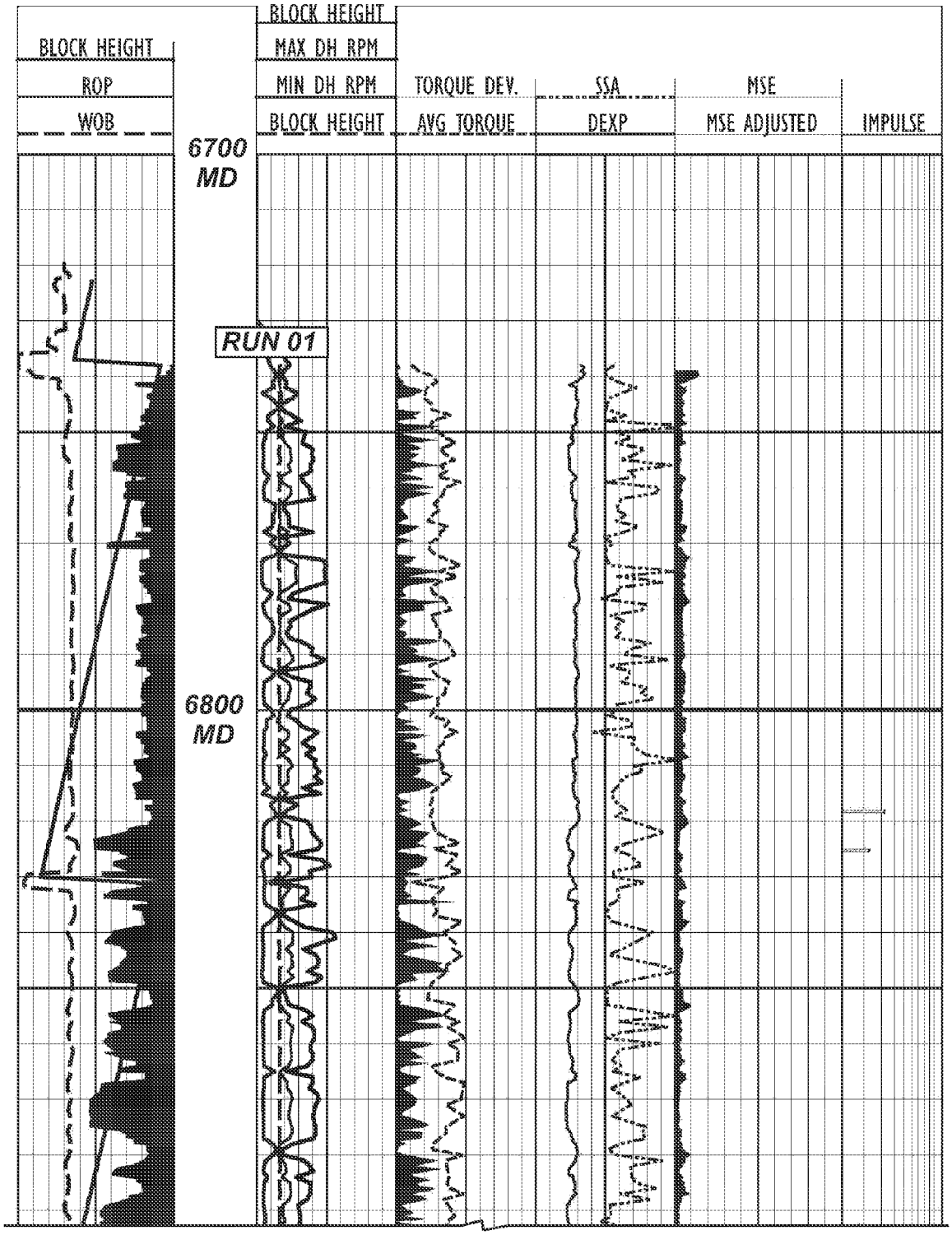
FIGS. 4A-4I show a graph of measurement-while-drilling (MWD) data.
Figure 4B:
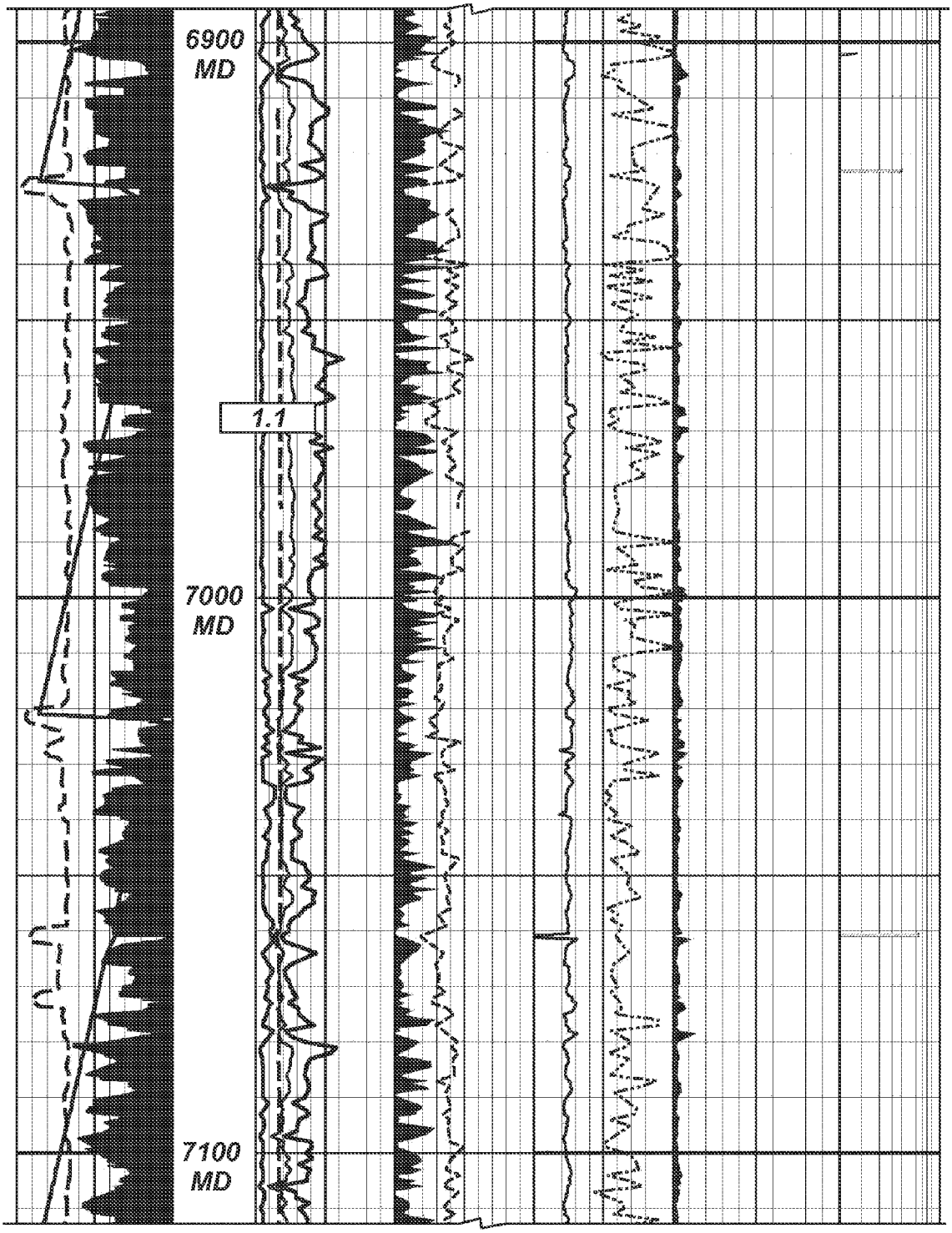
Figure 4C:
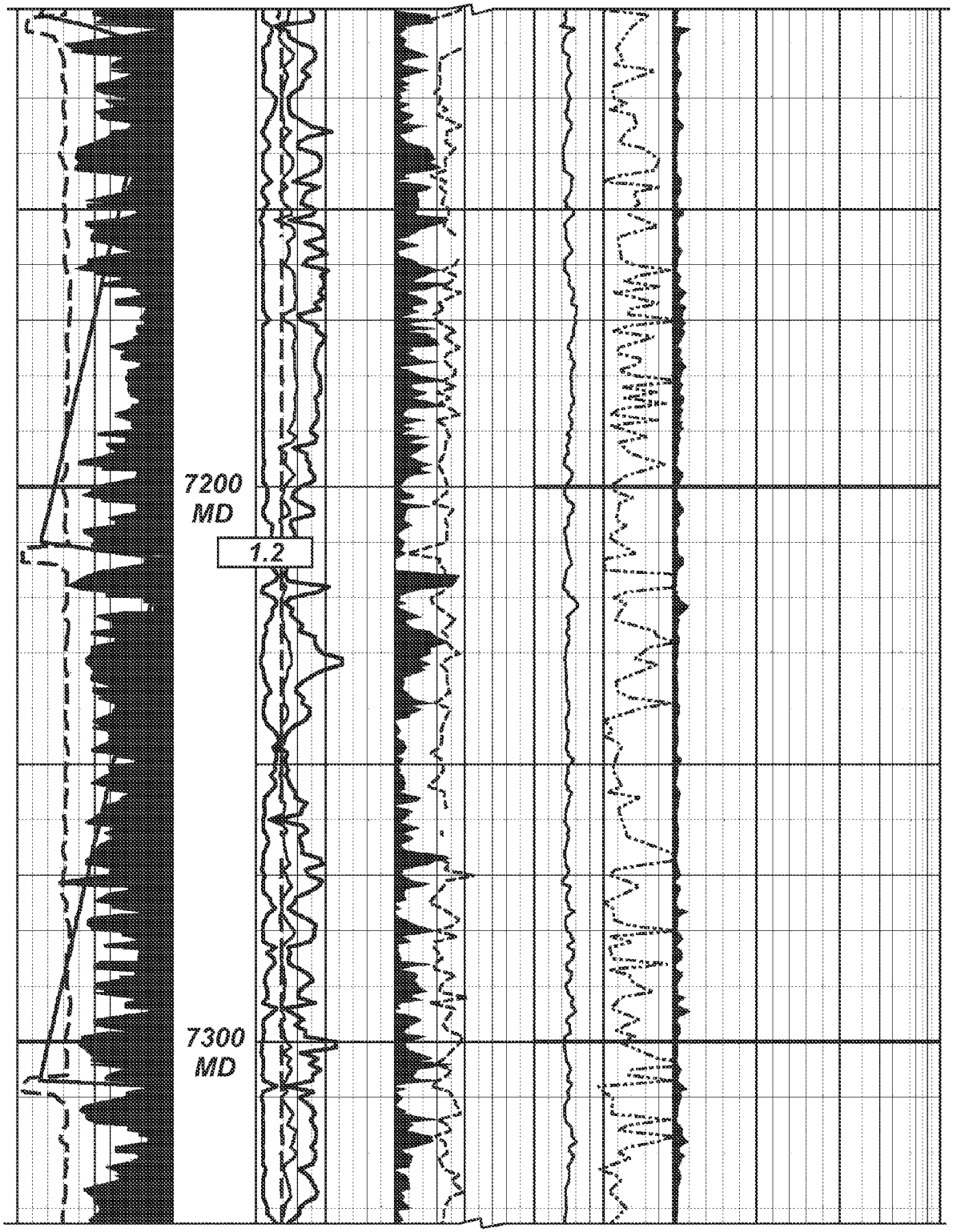
Figure 4D:
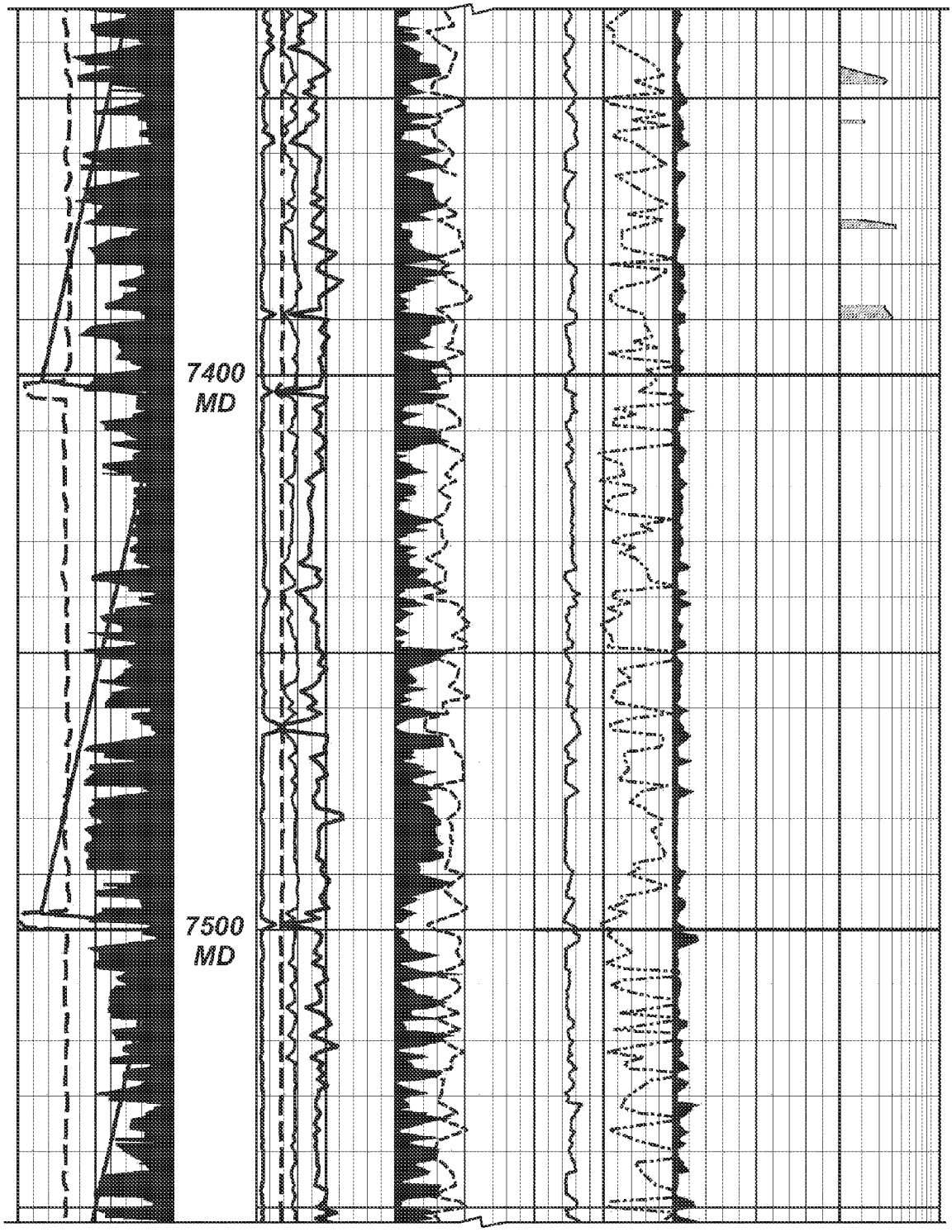
Figure 4E:
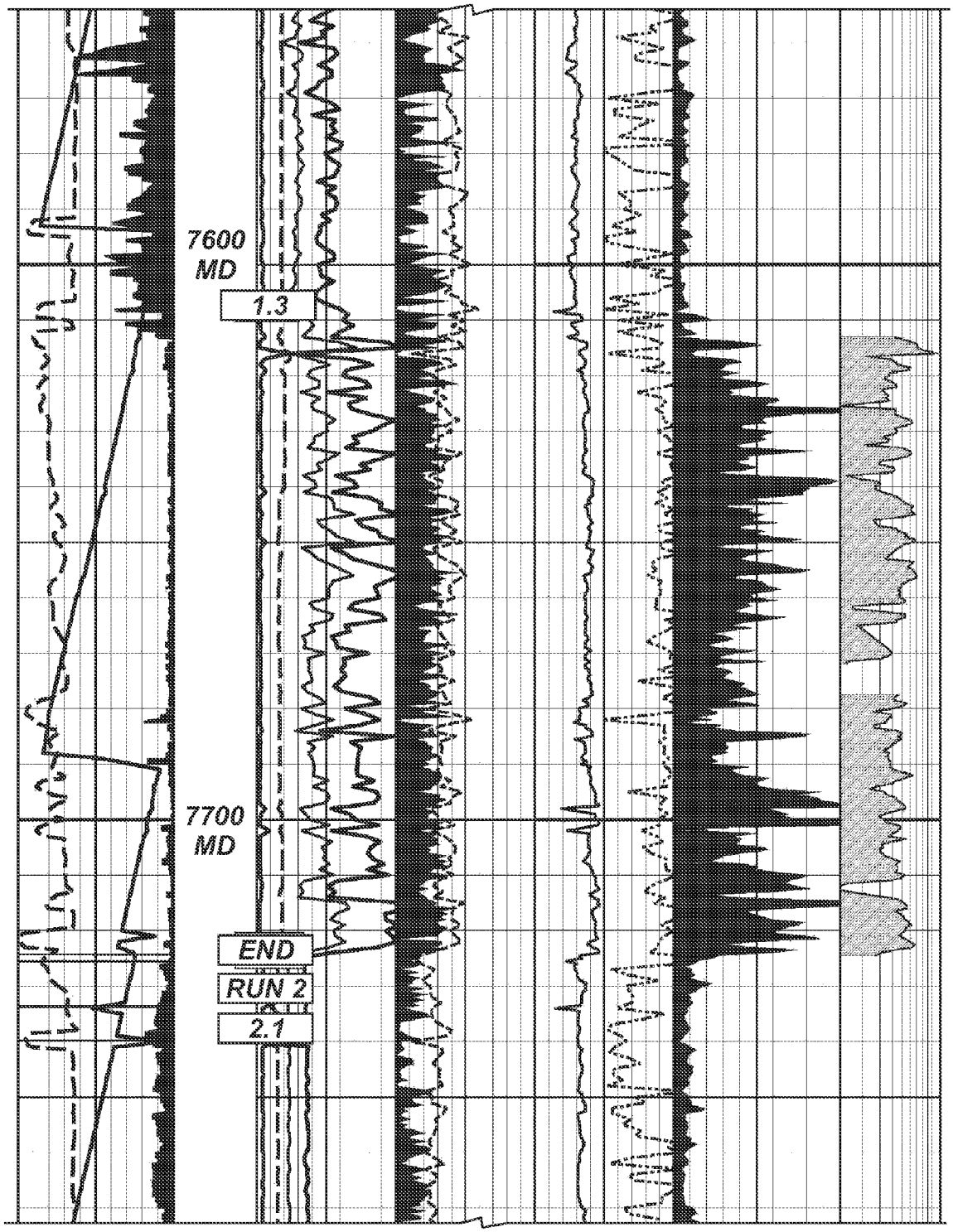
Figure 4F:
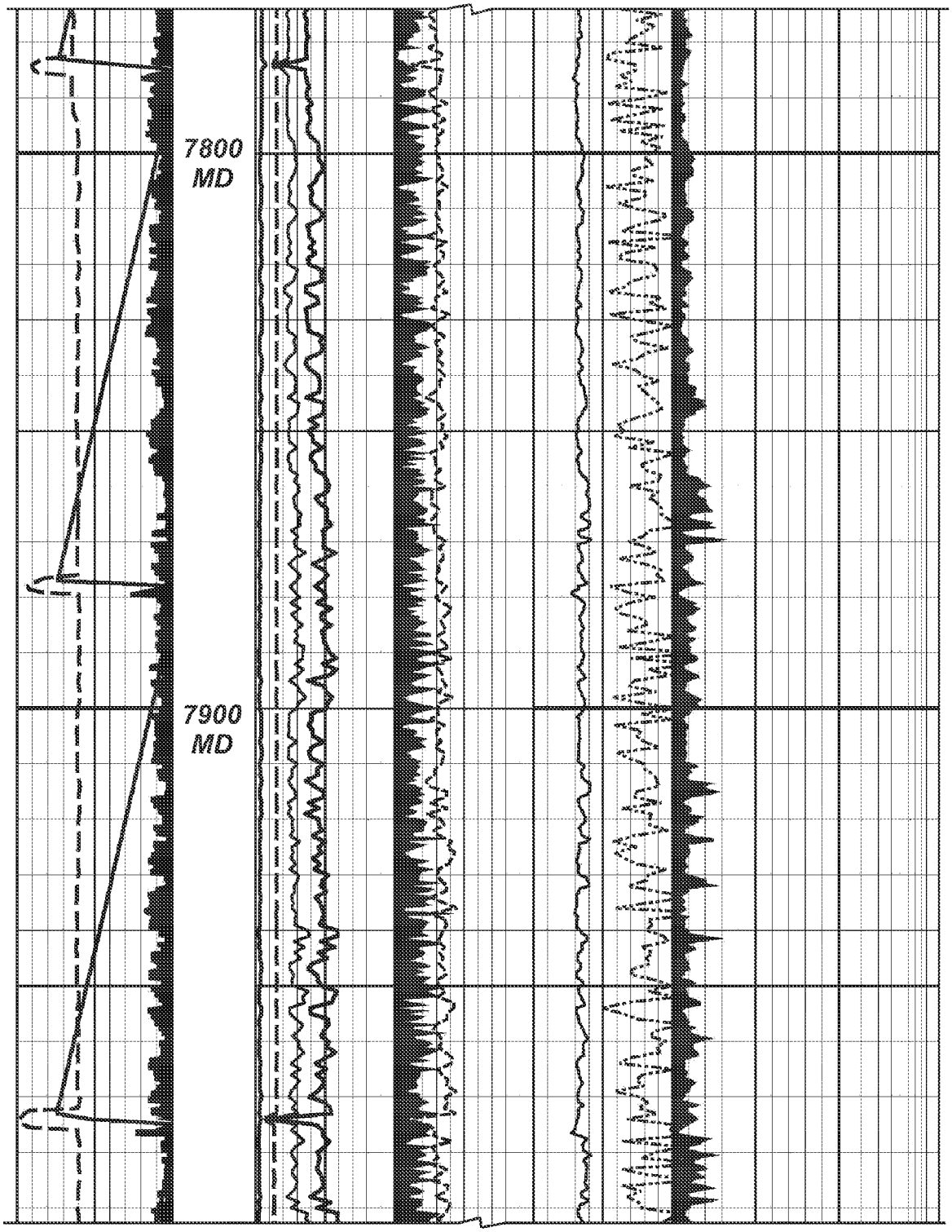
Figure 4G:
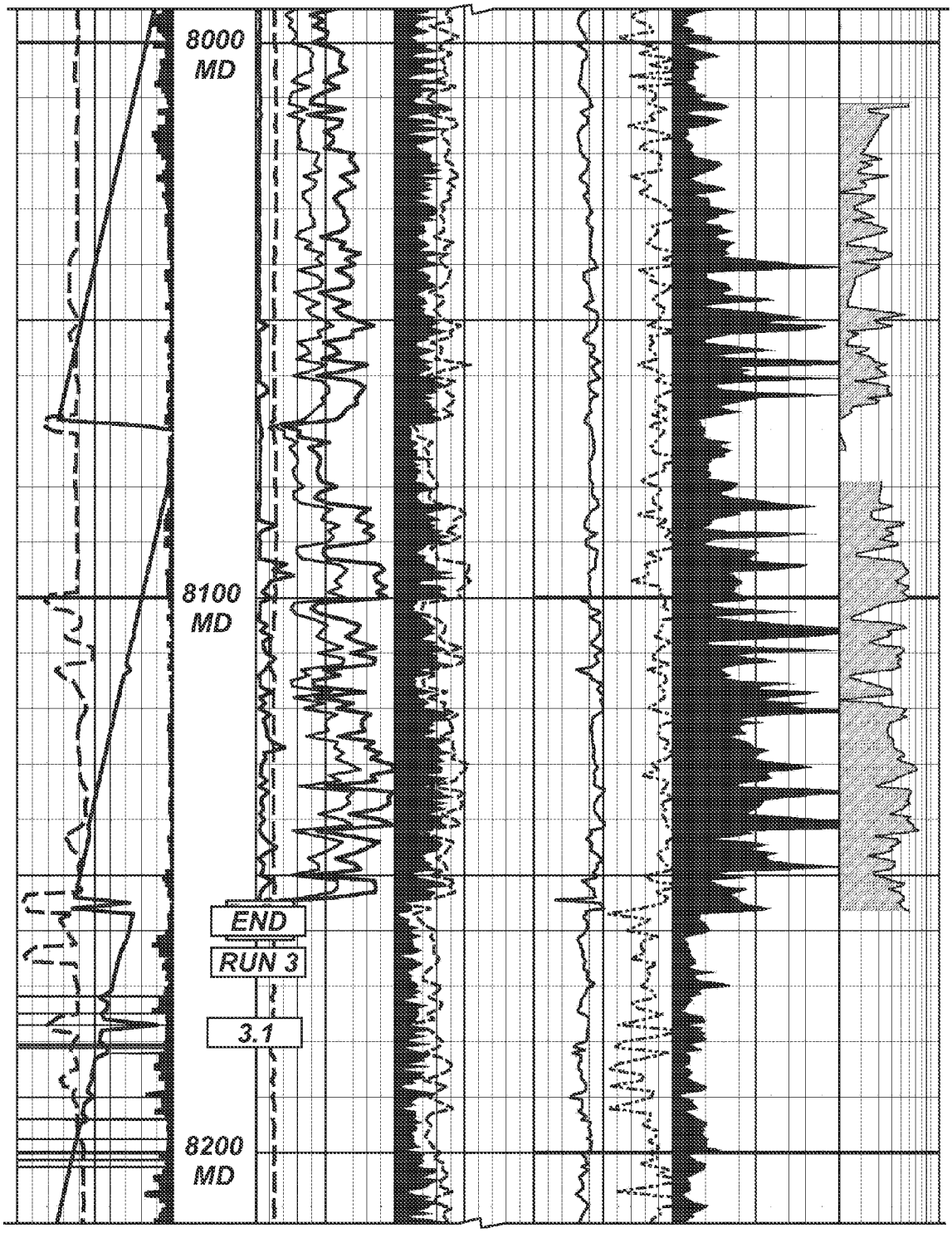
Figure 4H:
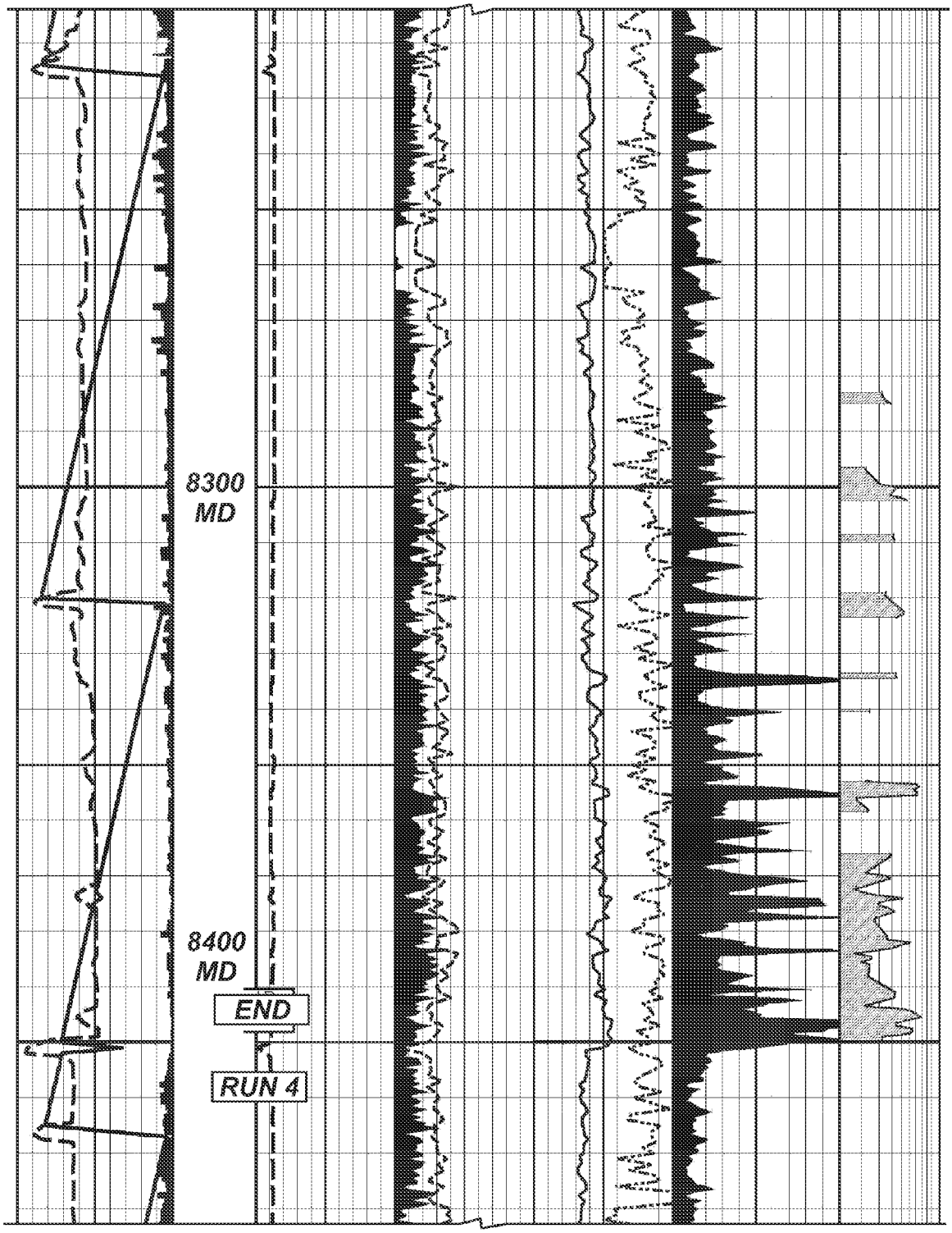
Figure 4I:
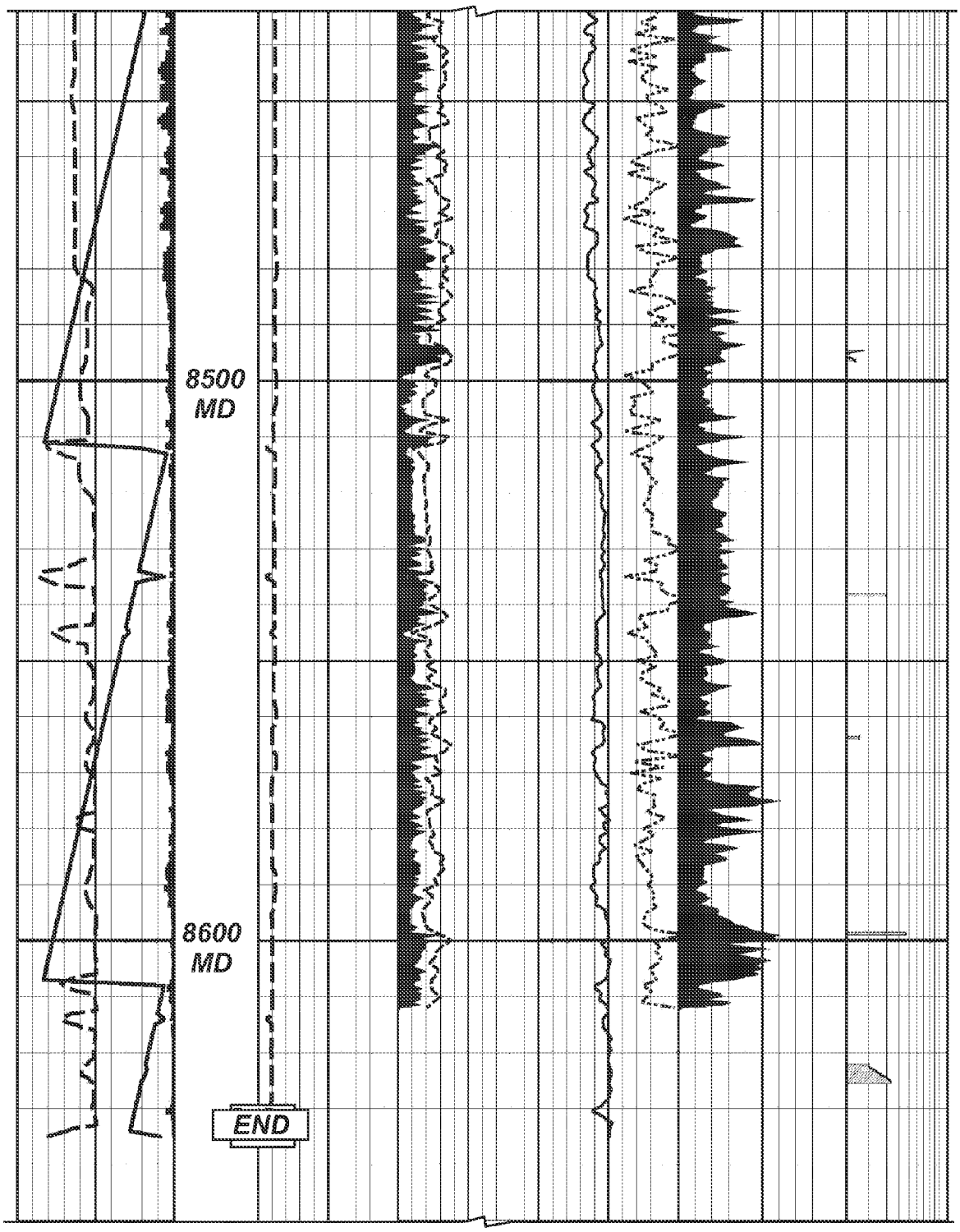

FIG. 1 shows a measurement-while-drilling (MWD) system 10 having a vibration monitoring tool 20, which is shown in isolated view in FIG. 2A. During drilling, the vibration monitoring tool 20 monitors vibration of the drillstring 14 having a drilling assembly 16 (collar 17, stabilizer, 18, drill bit 19, etc.) and monitors the drilling assembly 16's revolutions-per-minute (RPM). The vibration includes primarily lateral vibration (L) and axial vibration (A). Based on the monitoring, the vibration monitoring tool 20 provides real-time data to the surface to alert operators when excessive shock or vibration is occurring. Not only does the real-time data allow the operators to appropriately vary the drilling parameters depending on how vibrations are occurring, the data also allows the operators to determine when and if the drilling assembly 16 has lost its effectiveness and should be changed.

In one implementation, the vibration monitoring tool 20 can be Weatherford's Hostile Environment Logging (HEL) MWD system and can use Weatherford's True Vibration Monitor (TVM) sensor unit 30 mounted on the same insert used for gamma ray inserts on the (HEL) MWD system. As diagrammatically shown in FIG. 2B, the sensor unit 30 has a plurality of accelerometers 32 arranged orthogonally and directly coupled to the insert in the tool 20. The accelerometers 32 are intended to accurately measure acceleration forces acting on the tool 20 and to thereby detect vibration and shock experienced by the drill string 14 downhole. To monitor the drill collar 16's RPM, the tool 20 can have magnetometers 34 arranged on two axes so the magnetometers 34 can provide information about stick-slip vibration occurring during drilling. The downhole RPM combined with the accelerometer and magnetometer data helps identify the type of vibrations (e.g., whirl or stick-slip) occurring downhole. Knowing the type of vibration allows operators to determine what parameters to change to alleviate the experienced vibration.

The tool 20 is programmable at the well site so that it can be set with real-time triggers that indicate when the tool 20 is to transmit vibration data to the surface. The tool 20 has memory 50 and has a processor 40 that processes raw data downhole. In turn, the processor 40 transmits the processed data to the surface using a mud pulse telemetry system 24 or any other available means. Alternatively, the tool 20 can transmit raw data to the surface where processing can be accomplished using surface processing equipment 50. The tool 20 can also record data in memory 50 for later analysis.

For example, operators can program the tool 20 to sample the sensor unit 30's accelerometer data at time ranges of 1-30 seconds and RPM data at time ranges of 5-60 seconds, and the tool 20 can measure the sensors about 1,000 times/sec. In addition, real-time thresholds for shock, vibration, and RPM can be configured during programming of the tool 20 to control when the tool 20 will transmit the data to the surface via mud pulse telemetry to help optimize real-time data bandwidth.

The tool 20 can be set for triggered or looped data transmission. In triggered data transmission, the tool 20 has thresholds set for various measured variables so that the tool 20 transmits data to the surface as long as the measurements from the tool 20 exceed one or more of the thresholds of the trigger. In looped data transmission, the tool 20 continuously transmits data to the surface at predetermined intervals. Typically, the tool 20 would be configured with a combination of triggered and looped forms of data transmission for the different types of variables being measured.

During drilling, various forms of vibration may occur to the drillstring 14 and drilling assembly 16 (i.e., drill collar 17, stabilizers 18, drill bit 19, rotary steerable system (not shown, etc.). In general, the vibration may be caused by properties of the formation 15 being drilled or by the drilling parameters being applied to the drillstring 14 and other components. Regardless of the cause, the vibration can damage the drilling assembly 16, reducing its effectiveness and requiring one or more of its components to be eventually replaced or repaired. The damage to components, such as the stabilizers, caused by the vibrations can be very similar in appearance to the damage experienced by the drill bit 19.

To deal with damage and wear on the drilling assembly 16, the techniques of the present disclosure identify and quantify levels of downhole drilling vibration that are high enough to impact drilling efficiency. To do this, the tool 20 uses its orthogonal accelerometers 35 in the sensor unit 30 to measure the acceleration of the drillstring 14 in three axes. The processor 40 process the acceleration data by using impulse calculations as detailed below. The processor 40 then records the resultant impulse values and transmits them to the surface. Analysis of the transmitted values by the surface equipment 50 indicates when inefficient drilling is occurring, including inefficient drilling caused by damaging vibration to the drilling assembly 16, such as stabilizer 18 and/or drill bit 19. In addition to or in an alternative to processing at the tool 20, the raw data from the sensor unit 30 can be transmitted to the surface where the impulse calculations can be performed by the surface processing equipment 50 for analysis. Each of the processor 40, accelerometers 32, magnetometers 34, memory 50, and telemetry unit 24 can be those suitable for a downhole tool, such as used in Weatherford's HEL system.

As hinted above, the present techniques for analyzing drilling efficiency are based on impulse, which is the integral of a force with respect to time. In essence, the impulse provides a rate of change in acceleration of the drillstring 14 during the drilling operation. When at high enough levels, the impulse rate of change alerts rig operators of potential fatigue and other damage that may occur to the drilling assembly 16. In addition, as the impulse values increase, the amount of energy available at the drill assembly 18 decreases, resulting in reduced drilling efficiency. Thus, monitoring the impulse values in real-time or even in near-time can improve the drilling operation's efficiency. In general, the impulse for the drillstring 14 can be calculated laterally and axially for use in analysis, and a total impulse in three axes can also be calculated In addition, the impulse can be correlated to the number of shocks occurring to calculate an impulse shock density for use in the analysis. Further details of these calculations and the resulting analysis are discussed below.

FIG. 3 shows an impulse analysis technique 100 according to the present disclosure in which impulse of the drillstring 14 is calculated and used to determine whether the drilling assembly 16 is drilling inefficiently and needs to be pulled out. The tool 20 of FIG. 2 using the sensor unit 30 measures acceleration data in three orthogonal axes downhole while drilling with the drilling assembly 16 (Block 102). Using the acceleration data, impulse to the drillstring 14 in at least one direction (i.e., axial, lateral, both, or a total of both) is calculated over an acquisition period (Block 104), and a determination is made whether the calculated impulse exceeds a predetermined acceleration threshold for the acquisition period (Block 106). In one implementation, the predetermined acceleration threshold is 7 g, and the acquisition period is one second, although the particular threshold and period can depend on details of a particular implementation.

Calculating the impulse involves integrating rectified acceleration data in the at least one direction over the acquisition period. For example, the impulse can be calculated in one or more of a lateral direction (x and y-axes), an axial direction (z-axis), and/or a total of the three orthogonal axes (x, y, and z) of acceleration data. To calculate impulse, a number of impulse shocks that exceed the predetermined threshold for the acquisition period can also be counted. In turn, this impulse shock count can then be used with the impulse value to calculate an impulse shock density value that can be used for analysis.

Impulse exceeding the threshold is then correlated to the efficiency of the drilling assembly 16 so a determination can be made whether to pull the drilling assembly 16 (Block 108). Correlating the calculated impulse to efficiency of the assembly 16 involves determining whether the calculated impulse occurs continuously over a predefined penetration depth through the formation. The impulse used in the correlation can include the impulse values in one or more of the lateral, axial, and total directions and can include the impulse shock count as well as the impulse shock density discussed previously.

In one implementation, the predefined penetration depth for correlating to the drilling assembly's inefficiency is 25-feet through the formation, but this depth can depend on a number of variables such as characteristics of the assembly 16, drill bit 19, stabilizers 18, the formation, drilling parameters, etc. If the calculated impulse does occur continuously over the predefined penetration depth, a determination is made to pull the drilling assembly 16 (Block 110). Otherwise, the assembly 16 is not pulled.

In general, the tool 20 of FIG. 2 can perform the calculations and perform the determination using the processor 40 and can transmit the impulse data to the surface using the mud pulse telemetry system 24, where surface processing equipment 50 can be used to make the correlation and determination to pull the bit. Alternatively, the tool 20 of FIG. 2A can transmit raw data to the surface using the mud pulse telemetry system 24, and surface processing equipment 50 can perform the calculations for making the determination.

A. Calculations

Several real-time data items and calculations can be used for analyzing impulse experienced by the drillstring 14 during drilling. The real-time data items and calculations are provided by the vibration monitoring tool 20 of FIGS. 1-2. In one implementation, real-time data items can be identified that cover acceleration, RPM, peak values, averages, etc. As detailed herein, tracking these real-time data items along with the impulse calculation values helps operators to monitor drill bit efficiency and determine when the drill bit needs to be pulled out.

In particular, the tool 20 tracks a number of data items that are used to monitor impulse and shocks to be correlated to inefficiency of the drilling assembly 16. The tool 20 itself or the processing equipment 50 at the surface can perform the calculations necessary to determine when to replace portion of the drilling assembly 16, such as a stabilizer 18 or the drill bit 19. The impulse and shocks can be monitored and calculated in an axial direction, lateral direction, and/or a total of these two directions as follows:

1. Axial Direction

For the axial direction (i.e., z-axis), the calculated data items include the average axial acceleration, the axial impulse, the number of axial shock events, and the axial impulse shock density (ISD) for an acquisition period. The average axial acceleration over a 1-sec acquisition period can be characterized as:

$$\text{Axial_Average}(1\ \text{sec}) = \sum_{1}^{1000} \text{Z_inst}(1\ \text{ms})$$

The axial impulse is the integration of the rectified z-acceleration that exceeds the predetermined threshold for the acquisition period. Preferably, the threshold is 7 g. Accordingly, axial impulse over the 1-sec acquisition period can be characterized as:

$$\text{Axial_impluse}(1\ \text{sec}) = \sum_{1}^{1000} \text{Z_inst}(1\ \text{ms}) > \textit{Theshold}$$

The axial impulse shock density (ISD) is calculated from the axial impulse and the number of axial shock events that have occurred during the acquisition period. In other words, the axial shock events are the total number of z-shocks that have exceed the predetermined threshold of 7 g for the 1-sec acquisition period. The axial impulse shock density (ISD) is characterized as:

$$\text{Axial_ISD}(1\ \text{sec}) = \left(\frac{(\text{Axial_impulse}(1\ \text{sec}))^2}{\text{Axial_shockevents}(1\ \text{sec})}\right) * 1000$$

For a given impulse energy, the impulse shock density goes down as the frequency of shocks goes up. The reverse is also true. As the frequency of shocks goes down, the impulse shock density value increases. Therefore, the value of the impulse shock density has a shock frequency component because higher frequency shocks take less energy to produce than lower frequency shocks. In other words, the more energy that is used to produce the vibration, then the less energy can be used to drill the hole. This information can be useful then in analyzing the drilling operation and determining drill bit efficiency.

2. Lateral Direction

Calculations for the lateral direction are similar to those discussed above, but use acceleration in the x & y-axes. In particular, the average lateral acceleration is calculated as:

$$\text{Lateral_Average}(1\ \text{sec}) = \sum_{1}^{1000} \sqrt{(\text{X_inst}(1\ \text{ms}))^2 + (\text{Y_inst}(1\ \text{ms}))^2}$$

The lateral Impulse is the integration of the rectified lateral (x and y axes) acceleration that exceeds a predetermined threshold of 7 g for the 1-sec acquisition period. Therefore, the lateral impulse is calculated as:

$$\text{Lateral_impulse}(1\ \text{sec}) = \sum_{1}^{1000} \sqrt{(\text{X_inst}(1\ \text{ms}))^2 + (\text{Y_inst}(1\ \text{ms}))^2} > \textit{Theshold}$$

In turn, the lateral impulse shock density (ISD) is then calculated from the lateral impulse and number of lateral shock events over the acquisition period as follows:

$$\text{Lateral_ISD}(1\ \text{sec}) = \left(\frac{(\text{Lateral_impulse}(1\ \text{sec}))^2}{\text{Lateral_shockevents}(1\ \text{sec})}\right) * 1000$$

3. Total

Calculations for the total of all directions are similar to those discussed above, but use acceleration in the x, y, & z-axes. In particular, the average total acceleration is calculated as:

In particular, the average total acceleration is calculated as:

$$\text{Total_Average}(1\ \text{sec}) = \sum_{1}^{1000} \sqrt{(\text{X_inst}(1\ \text{ms}))^2 + (\text{Y_inst}(1\ \text{ms}))^2 + (\text{Z_inst}(1\ \text{ms}))^2}$$

The total Impulse is the integration of the rectified total (x, y, and z axes) acceleration that exceeds a predetermined threshold of 7 g for the 1-sec acquisition period. Therefore, the total impulse is calculated as:

$$\text{Total_impulse}(1\ \text{sec}) = \sum_{1}^{1000} \sqrt{(\text{X_inst}(1\ \text{ms}))^2 + (\text{Y_inst}(1\ \text{ms}))^2 + (\text{Z_inst}(1\ \text{ms}))^2} > \textit{Theshold}$$

In turn, the total impulse shock density (ISD) is then calculated from the total impulse and number of total shock events over the acquisition period as follows:

$$\text{Total_ISD}(1\ \text{sec}) = \left(\frac{(\text{Total_impulse}(1\ \text{sec}))^2}{\text{Total_shockevents}(1\ \text{sec})}\right) * 1000$$

As noted previously, the calculated data items can be calculated by the tool 20 downhole and pulsed uphole, or they can be calculated at the surface by processing equipment 50 based on raw data pulsed uphole from the tool 20. According to the present techniques discussed above, the calculated impulses, shocks, and impulse shock density are used to analyze the efficiency of the drilling assembly 16 and to determine whether the assembly 16 needs to be pulled. Operators can also use the data items and the calculated impulses, shocks, and impulse shock density to analyze the drilling efficiency so that drilling parameters can be changed accordingly.

As noted above in the calculations, the impulse is the integration of acceleration above a predetermined threshold during an acquisition period. Shocks are the number of vibration events that exceeded a predetermined threshold during the acquisition period. In the present implementation, the predetermined threshold is defined as an acceleration of 7 g, and the acquisition period is one (1) second. However, these values may vary depending on a particular implementation.

B. Log

FIGS. 4A-4I show a log showing exemplary logging information for several runs. Some of the plotted logging information, including impulse data, is obtained from the vibration monitoring tool (20; FIGS. 1-2) while drilling. The log includes typical data such as block height, bit's rate of penetration (ROP), and Weight on bit (WOB), torque, stick slip alert (SSA), drilling rate of penetration (DEXP), and mechanical specific energy (MSE), as well as average, max, and min downhole RPM and surface RPM—each of which is plotted vertically with depth. Also, the impulse (lateral in this example) is plotted with depth.

During drilling, the impulse data (axial, lateral, and total impulse data, shock data, and impulse shock density) is calculated at the tool (20; FIGS. 1-2) and pulsed to the surface. Recalling that the impulse data is triggered based on a predetermined threshold within an acquisition period, the impulse data of particular consideration may not be sent to the surface, whereas other data from the tool (20) may. When impulse data is encountered and sent to the surface, however, it is correlated as a function of reduced performance or efficiency of the drilling assembly as described herein to indicate to operators that the assembly is no longer functioning effectively and needs to be pulled.

In one particular implementation, for example, the impulse algorithm determines when the triggered impulse data has occurred over a continuous drilling length of 25-feet or so. If this happens, the algorithm assumes at this point that the drilling assembly 16 is no longer drilling efficiently and that it is time to pull the assembly 16 out to replace or repair its components, such as a stabilizer 18 or drill bit 19. If the impulse data is not encountered for that continuous length, then the operator may not need to pull the assembly 16 out because it still may be effective. In this case, the algorithm would not indicate that the drilling assembly 16 needs to be pulled.

In the sections of the log marked "RUN 1" and "RUN 2," for example, operators drilled without the benefit of the real-time impulse data for determining whether to pull the drilling assembly out or not. In both of these runs, operators continued drilling to the extent that the drill bit was damaged beyond repair. If the operators had the benefit of the real-time impulse data and calculations of the present disclosure, the ineffectual progress in drilling and unrepairable damage to the drill bit could have been avoided and/or reduced in severity because the real-time impulse data and calculations would have indicated to the operators to pull the assembly at a more appropriate time.

In the section of the log marked "RUN 4," for example, a continuous 25-feet of impulse data was not encountered. Therefore, the operators did not need to pull the drilling assembly 16 so early during this run. As a result, pulling the assembly out too soon can waste considerable amount of rig time. Although the above log has been discussed with reference to the efficiency of the drill bit, the determination of when other components of the drilling assembly, such as stabilizers or the like, have experienced damage to the extent of no longer being effective is similar to that applied to the drill bit.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole drilling vibration analysis method, comprising:

measuring acceleration data in three orthogonal axes downhole while drilling with a drilling assembly;

calculating, with processing circuitry, impulse in at least one direction using the measured acceleration data over an acquisition period;

determining, with the processing circuitry, whether the calculated impulse exceeds a predetermined threshold for the acquisition period;

correlating, with the processing circuitry, the calculated impulse to efficiency of the drilling assembly based on the determination; and determining, with the processing circuitry, whether to pull the drilling assembly based on the correlation.

2. The method of claim 1, wherein the drilling assembly comprises a drill bit, and wherein correlating the calculated impulse to efficiency of the drilling assembly is based on the efficiency of the drill bit.

3. The method of claim 1, wherein the drilling assembly comprises a stabilizer, and wherein correlating the calculated impulse to efficiency of the drilling assembly is based on the efficiency of the stabilizer.

4. The method of claim 1, wherein measuring the acceleration data comprises measuring acceleration with at least three orthogonally arranged accelerometers mounted in a downhole tool.

5. The method of claim 1, further comprising transmitting the impulse data to the surface.

6. The method of claim 1, further comprising transmitting raw data to the surface and calculating the impulse data at the surface based on the raw data.

7. The method of claim 1, wherein the predetermined threshold is a g-force of 7 g, and wherein the acquisition period is one second.

8. The method of claim 1, wherein correlating the calculated impulse to efficiency of the drilling assembly comprises determining whether the calculated impulse occurs continuously over a predefined penetration depth through the formation.

9. The method of claim 8, wherein the predefined penetration depth is 25-feet through the formation.

10. The method of claim 8, wherein if the calculated impulse does occur continuously over the predefined penetration depth, a real-time determination to pull the drilling assembly is made.

11. The method of claim 8, wherein if the calculated impulse does not occur continuously over the predefined penetration depth, a real-time determination to pull the drilling assembly is not made.

12. The method of claim 1, wherein calculating the impulse comprises integrating rectified acceleration data in the at least one direction over the acquisition period.

13. The method of claim 1, wherein calculating the impulse comprises calculating the impulse in one or more of a lateral direction, an axial direction, and a combination of the lateral and axial directions.

14. The method of claim 1, wherein the lateral direction is derived from first acceleration data in an x-axis and second acceleration data in a y-axis, the axial direction is derived from third acceleration data in a z-axis, and the combination is derived from the first, second and third acceleration data in the three orthogonal axes.

15. The method of claim 1, wherein calculating the impulse comprises counting a number of impulse shocks that exceed the predetermined threshold for the acquisition period.

16. The method of claim 15, wherein calculating the impulse comprises correlating a value of the calculated impulse for the acquisition period to the number of impulse shocks counted for the acquisition period.

17. The method of claim 16, wherein correlating the value to the impulse shock number comprises calculating an impulse shock density as equal to (Impulse^2/shock number) *1000.

18. A downhole drilling vibration analysis system, comprising:

a plurality of accelerometers measuring acceleration data in three orthogonal axes downhole while drilling with a drilling assembly; and processing circuitry configured to:

calculate impulse in at least one direction using the measured acceleration data over an acquisition period;

determine whether the calculated impulse exceeds a predetermined acceleration threshold for the acquisition period;

correlate the calculated impulse to efficiency of the drilling assembly based on the determination; and determine whether to pull the drilling assembly based on the correlation.

19. The system of claim 18, wherein the drilling assembly comprises a drill bit, and wherein the processing circuitry correlates the calculated impulse to efficiency of the drilling assembly based on the efficiency of the drill bit.

20. The system of claim 18, wherein the drilling assembly comprises a stabilizer, and wherein the processing circuitry correlates the calculated impulse to efficiency of the drilling assembly based on the efficiency of the stabilizer.

21. The system of claim 18, wherein to measure the acceleration data, the system comprises at least three orthogonally arranged accelerometers mounted in a downhole tool.

22. The system of claim 18, further comprising a mud pulse telemetry unit configured to transmit the impulse to the surface.

23. The system of claim 18, further comprising a mud pulse telemetry unit configured to transmit raw data to the surface for calculating the impulse at the surface based on the raw data.

24. The system of claim 18, wherein the predetermined acceleration threshold is a g-force of 7 g, and wherein the acquisition period is one second.

25. The system of claim 18, wherein to correlate the calculated impulse to efficiency of the drilling assembly, the processing circuitry is configured to determine whether the calculated impulse occurs continuously over a predefined penetration depth through the formation.

26. The system of claim 25, wherein the predefined penetration depth is 25-feet through the formation.

27. The system of claim 25, wherein if the calculated impulse does occur continuously over the predefined penetration depth, a real-time determination to pull the drilling assembly is made.

28. The system of claim 25, wherein if the calculated impulse does not occur continuously over the predefined penetration depth, a real-time determination to pull the drilling assembly is not made.

29. The system of claim 18, wherein to calculate the impulse, the processing circuitry is configured to integrate rectified acceleration data in the at least one direction over the acquisition period.

30. The system of claim 18, wherein to calculate the impulse, the processing circuitry is configured to calculate the impulse in one or more of a lateral direction, an axial direction, and a total of the three orthogonal axes of acceleration data.

31. The system of claim 18, wherein to calculate the impulse, the processing circuitry is configured to count a number of impulse shocks that exceed the predetermined threshold for the acquisition period.

32. The system of claim 31, wherein to calculate the impulse, the processing circuitry is configured to correlate a value of the calculated impulse for the acquisition period to the number of impulse shocks counted for the acquisition period.

33. The system of claim 18, wherein a downhole tool comprises the plurality of accelerometers and a first processor, the first processor configured to calculate the impulse and determine whether the calculated impulse exceeds the predetermined acceleration threshold for the acquisition period.

34. The system of claim 33, wherein surface equipment comprises a second processor configured to correlate the calculated impulse and determine whether to pull the drilling assembly based on the correlation.

35. The system of claim 18, wherein a downhole tool comprises the plurality of accelerometers, and wherein surface equipment comprises the processing circuitry.

* * * * *